US006247408B1

(12) United States Patent
Andrejkovies et al.

(10) Patent No.: US 6,247,408 B1
(45) Date of Patent: Jun. 19, 2001

(54) SYSTEM FOR SYMPATHETIC DETONATION OF EXPLOSIVES

(75) Inventors: Richard Andrejkovies, Blairstown, NJ (US); Frank Nappi, Valrico, FL (US); James Chopack, Columbia; Carl Campagnuolo, Potomac, both of MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/467,663

(22) Filed: Nov. 8, 1999

(51) Int. Cl.[7] ..... F42C 15/40

(52) U.S. Cl. ..... 102/200; 102/215; 102/217; 102/268

(58) Field of Search ..... 102/200, 215, 102/217, 268, 218, 214

(56) References Cited

U.S. PATENT DOCUMENTS 4,037,538 * 7/1977 Andrews et al. .
4,189,999 * 2/1980 Anderson .
4,478,149 * 10/1984 Backstein et al. .
4,576,093 * 3/1986 Snyder .
4,685,396 * 8/1987 Birse et al. .
4,884,506 * 12/1989 Guerreri .
5,159,149 * 10/1992 Marsden .
5,202,532 * 4/1993 Haglund et al. .
5,415,100 * 5/1995 Tolley .
5,415,103 * 5/1995 Rademacher .

FOREIGN PATENT DOCUMENTS

458178A2 * 11/1991 (EP) .
2200975 * 8/1988 (GB) .

* cited by examiner

*Primary Examiner*—Charles T. Jordan
*Assistant Examiner*—Troy Chambers
(74) *Attorney, Agent, or Firm*—Paul S. Clohan, Jr.

(57) ABSTRACT

A system is disclosed that remotely activates one or more explosive charge by sympathetic detonation (i.e., not requiring explosives to be interconnected by wire). The system includes electronics that control the activation of each explosive charge and which are responsive to an acoustic sensor, a seismic sensor and a hydrophone sensor. In one embodiment an RF transmitter, which prior to detonation of an explosive charge, sends a wake-up signal to another system for a sequentially controlled sympathetic detonation of one or more explosive charges.

2 Claims, 4 Drawing Sheets

SYSTEM FOR SYMPATHETIC DETONATION OF EXPLOSIVES

ORIGIN OF THE INVENTION

The invention described herein was made in the performance of official duties by employees of the Department of Army and may be manufactured, used, licensed by or for the Government for any governmental purpose without the payment of any royalty thereon or therefore.

BACKGROUND OF THE INVENTION 1.0 Field of the Invention

The present invention relates to a system for detonating explosives and, more particularly, to a system for remotely controlling and firing explosive charges by sympathetic detonation.

2.0 Description of the Prior Art

Explosive charges find usage to initiate and control avalanches or rock slides and for military applications. As is known in the art, a system for firing explosive charges includes a firing circuit that contains an arming device. As is also known and understood, a firing pulse is always processed first by the arming device. As used herein, for the sake of brevity, the usage of term "firing circuit" is meant to mean and is interchangeably referred to as "arming-firing circuit." For explosive charge usage, presently wires are used to physically connect a string of charges together. As the area in which explosive charges are used increases, so do the critical locations where explosive charges are placed. Generally, precisely placed explosive charges are used in lieu of one large, bulk charge. These small charges must be physically connected together by detonation cords or shock tubes to achieve effective simultaneous or sequential detonation which, in turn, effectively controls the avalanches, rock slides or destroys military targets. As the number of charges increases, the process of connecting the charges together requires the user to spend more time within the target area, thus increasing the safety risk, especially for military applications. Also, the user is required to carry large quantities of wire. It is desired that a system be provided for remotely controlling the detonation of an initial explosive charge and allowing for sympathetic detonation of follow-on charges. It is further desired, that the system (sympathetic detonator unit) be self-contained so that it can be emplaced within a target area by employing airborne means, and all units should function by sympathetic detonation. Further, it is desired that the system contain electronic circuitry, which controls power consumption. The electronic circuitry contains a manually-set delay timer and means to receive and emit RF signals.

SUMMARY OF THE INVENTION

Accordingly, it is a primary object of the present invention to provide a means for remotely controlling a primary firing device for detonation of an explosive charge. The primary firing device in turn activates and detonates a follow-on charge by sympathetic detonation. The follow-on charges can vary from 1 to n and are separated from one another by some distance. Each of the follow-on charges is called a SYDET unit. A SYDET unit contains a sensor suite, a settable timer and an RF link.

It is a further object of the present invention to provide a system for sympathetically controlling one or more firing devices in which each controls the detonating of a respective explosive charge.

It is still a further object of the present invention to provide for a self-contained system (consisting of many charges) which can be emplaced at desired target areas by airborne means.

It is a still further object of the present invention to provide a system having power-saving means and for sympathetically controlling explosive devices.

It is a still further object of the present invention to provide a SYDET unit which contains manual settable timers which are set to cause detonation by a time delay or absolute time.

In accordance with these and other objects, the invention provides a system that remotely controls a firing device for detonating an explosive charge. The system comprises one or more sensors selected from a group consisting of an acoustic sensor, a seismic sensor, and a hydrophone sensor. Each of the sensors provides an analog output signal. The system further comprises an analog digital (A/D) converter for each of the one or more selected sensors and each A/D converter receives the respective analog output signal and provides a corresponding digital output signal. The system further comprises one or more classifiers and a coincidence circuit. A classifier is provided for each of the one or more A/D converters and each classifier receives a respective digital signal of the A/D converter and compares the received digital signal against one or more predetermined quantities and provides an output signal if a match exists therebetween. The coincidence circuit, in one embodiment, receives the output signal of each of the classifiers and provides an output signal which is applied to the firing device when the output signals of the classifiers are all in coincidence. The preferred embodiment requires one or more sensors for activation. It is not excluded that one sensor with set detection levels can be used exclusively (e.g. in the surf zone a hydrophone is more effective than a seismic sensor or acoustic sensor). Depending on the field requirements, one or more sensors could be coupled together.

BRIEF DESCRIPTION OF THE DRAWINGS

The foregoing objects and advantages of the present invention will become more fully understood from the following detailed description taken in reference to the appended drawings wherein.

DETAILED DESCRIPTION OF THE PREFERRED EMBODIMENTS

Figure 1:
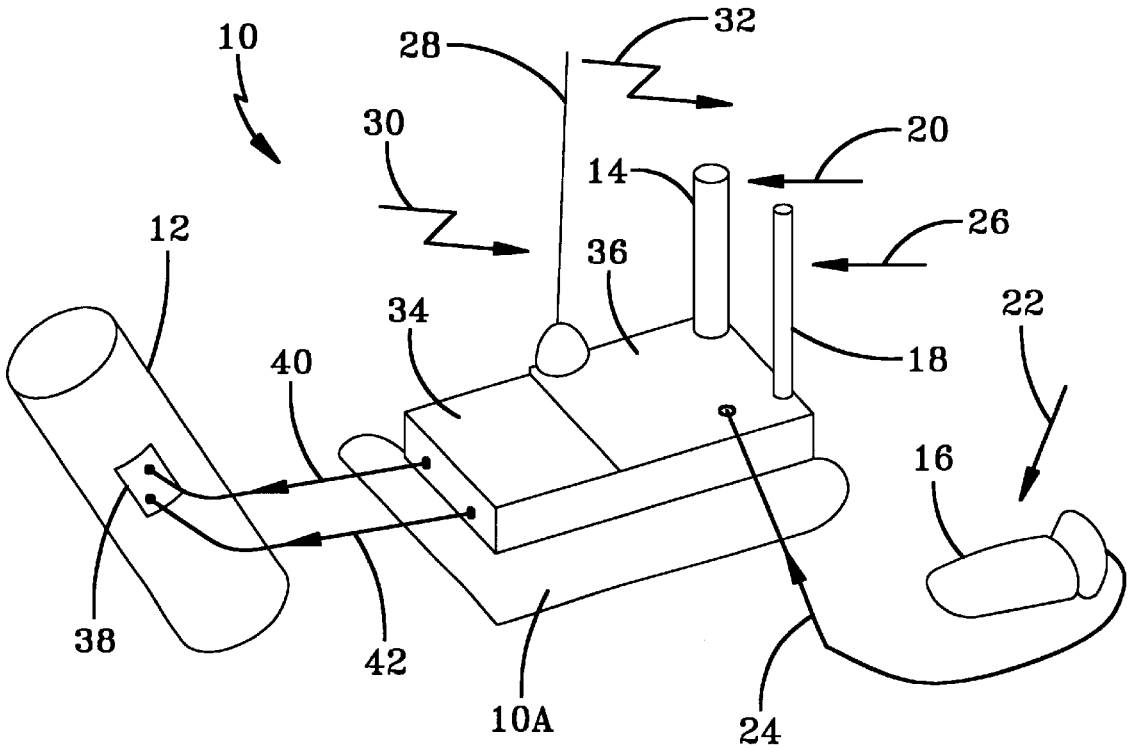
FIG. 1 is a schematic of the system (SYDET unit) of the present invention for remotely controlling a firing device for detonation of an explosive charge.

Referring to the drawings, wherein the same reference number indicates the same element throughout, there is shown in FIG. 1 a system 10, sometimes referred to herein as a SYDET unit, for remotely controlling a firing device for detonating an explosive charge 12. The system 10 employs one or more sensors selected from a group consisting of an acoustic sensor 14, a seismic sensor 16, and a hydrophone sensor 18 all sensors being known in the art. The acoustic sensor 14 collects acoustic waves of propagation shown by directional arrow 20 and converts such waves into electrical signals. The seismic sensor 16 collects terrestrial waves that are indicated by directional arrow 22, and in response thereto, provides an electrical output signals that are routed onto signal path 24. The hydrophone sensor 18 collects acoustic waves propagating in water and which are indicated by directional arrow 26 and converts such waves into electrical signals. Although three types of sensors are shown in FIG. 1, it is not excluded that one sensor with set detect levels can be used exclusively (e.g. in the surf zone, a hydrophone is more effective than a seismic sensor or acoustic sensor). Depending on the field requirements, one or more sensors could be coupled together. The system 10 further comprises an antenna 28 that picks up a signal 30 or radiates a signal 32.

The system 10 is preferably mounted on a platform 10A and further comprises batteries (not shown) that are located in a battery compartment 34 and that provide the system 10 with portable capabilities. The batteries with compartment 34 also provide power for electronics 36 which, as will be described with reference to FIG. 2, controls the activation of an initiator 38, by way of signal paths 40 and 42, which, in turn, detonates the explosive charge 12. Further, as will be described with reference to FIG. 2, full power from the batteries may be actuated in response to an external command signal.

In general, the system 10 remotely activates one or more explosive charges 12 by sympathetic detonation (i.e. not requiring explosives to be interconnected by wires). To obtain a sympathetic detonation, the electronics 36 detects, by means of sensors 14, 16, and 18, an explosion that has both acoustic and seismic characteristics. Alternatively, and in a manner to be more fully described with reference to FIG. 2, the electronics 36 may respond to the signal 30 received by antenna 28 for commanding the detonation of the explosive charge 12. Each of the sensors 14, 16 and 18 acts independently, wherein sensors 14 and 16 collect acoustical propagations and sensor 16 collects terrestrial waves. The electronics 36 that control the operation of the system 10 may be further described with reference to FIG. 2.

The electronics 36 comprises analog to digital (A/D) converters 46, 48, 50, which respectively receive the analog signals from the acoustic sensor 14, the hydrophone sensor 18, and the seismic sensor 16. Each of the A/D converters 46, 48, and 50 provides a digital output signal representative of its received analog signal. In actuality, the system 10 utilizes only the analog output of either the acoustic sensor 14 or the hydrophone sensor 18 and thus finds use for an OR circuit 52 that accepts the outputs of A/D converters 46 and 48 and provides a corresponding output therefrom. The OR circuit 52 and the A/D converter 50 respectively route their output signals to classifying routines 54 and 56 which, in turn, provide output signals to AND circuit 58.

In one embodiment of the practice of the present invention, the AND circuit 58 having only two inputs from classifying routines 54 and 56, acting as a coincidence circuit, provides an output signal when both outputs from classifying routines 54 and 56 are present. For such an embodiment, the output from AND circuit 58 is applied to an firing device 44 (known in the art) which, in turn, generates an output signal that is applied across signal paths 40 and 42 to cause the activation of the explosive charge 12.

Figure 4:
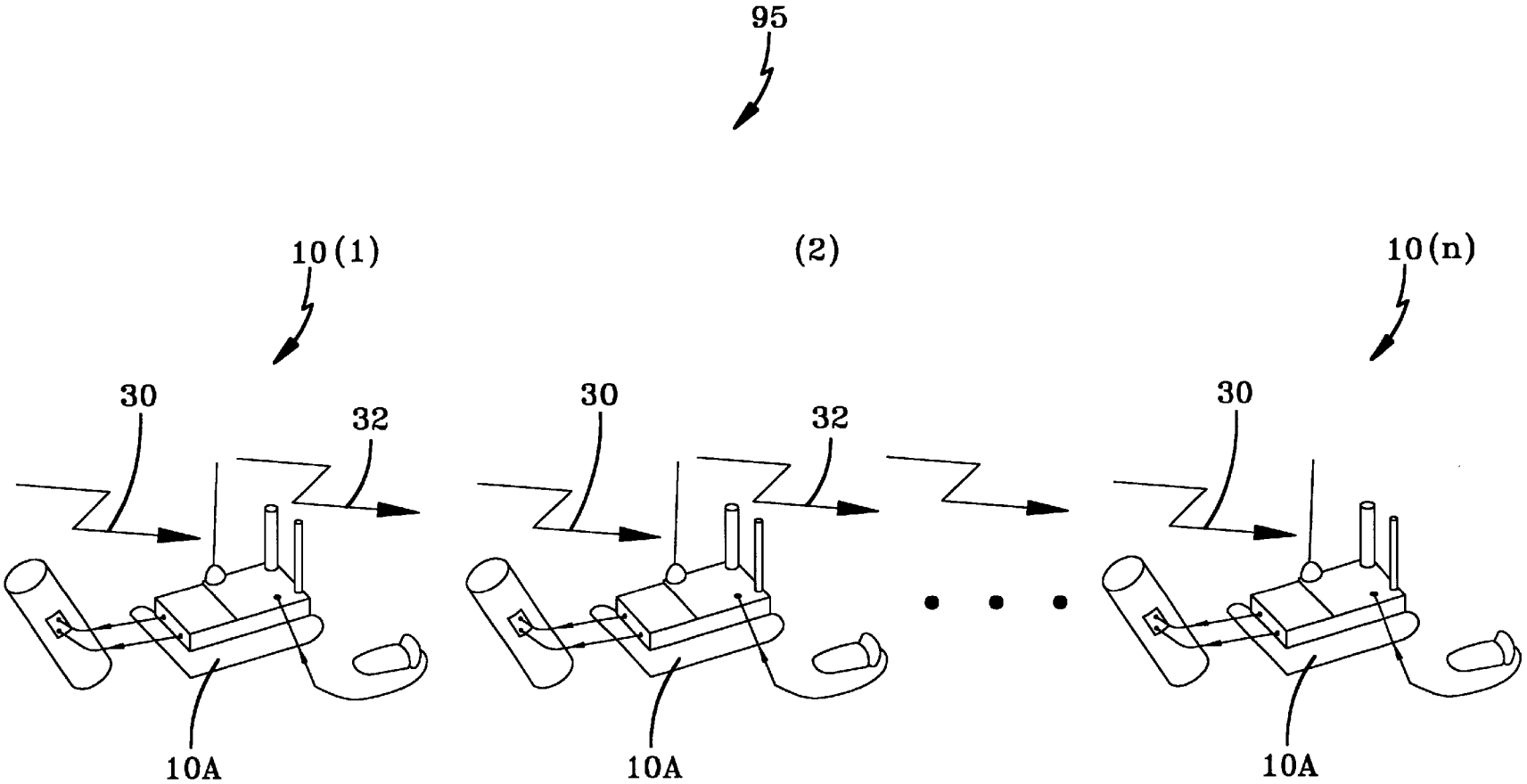
FIG. 4 is a schematic of the system for remotely controlling one or more firing devices each of which provides an output signal for sympathetic detonation of a follow-on explosive charge.

For another embodiment that remotely controls one or more firing devices and provides an output signal for detonating respective explosive charges, as shown in FIG. 4, the electronics 36 provides a receiver 60 for receiving the signal 30 by way of the antenna 28, and a verifier 62 for accepting the output of the receiver 60 and detecting and determining if the accepted output has a first predetermined identification code to be described, and, if so, providing an output signal. The verifier 62 provides the output signal to a circuit 64 and transmitter 66. The circuit 64 has a first variable time delay which, in turn, provides an output signal upon the expiration of its time delay. For such an embodiment, the AND circuit 58 provides an output signal when both outputs from classifying routines 54 and 56, as well as the output of the time delay circuit 64, are present. For such an embodiment, the output from AND circuit 58 is applied to an firing device 44 (known in the art) which, in turn, generates an output signal that is applied across signal paths 40 and 42 to cause the activation of the explosive charge 12.

For a further embodiment, also related to FIG. 4, the electronics 36 further comprises a transmitter 66. Upon receipt of signal 30 to receiver 60 and verification of signal by verifier 62, an output is provided to the transmitter 66 for generating a signal carrying a second predetermined identification code, to be further described, and which signal is applied to the antenna 28. All of the embodiments controlled by the electronics 36 are, in turn, controlled by the classifying routines 54 and 56 which may be further described with reference to FIG. 3, which shows an overall flow chart 74.

The overall flow chart 74 may be provided by a routine running in a microprocessor or by an electronic network. The overall routine 74 serves as means that determines if the sound received by the system 10 is representative of a valid explosion. This representation is termed a signature. The routine 74 is used in the classifying routine 54 to respond to an acoustic signature, whereas the routine 74 is used in the classifying routines 56 to respond to seismic signatures. Unless both the acoustic and seismic signatures correspond to those of a single or multiple known charge signal the firing circuit 44 will not initiate the detonation of the explosive charge 12. The routine 74 comprises program segments 76, 78, 80 and 82.

The program segment 76 receives a digital signal representative of acoustic information provided thereto by OR circuit 52 or receives a digital signal representative of seismic information and provided thereto by the A/D converter 50. Program 76 passes control to program segment 78 by way of signal path 84.

The program segment 78 compares the received signals against stored signatures. Program segment 78 then passes control to program segment 80 by way of signal path 86.

Program segment 80 is a decision segment whose answer is created by the program segment 78. More particularly, if the comparison performed by program segment 78 determines that the signatures of the received signals do not correspond to known signatures associated with known explosions then the signals are not valid, and program segment 80 passes control back to program segment 76, by way of signal path 88; however, if the comparisons performed by program segment 78 are valid, then program segment 80 passes control to program segment 82 by way of signal path 90.

Program segment 82 provides for an output signal that is routed to AND gate 58 and if both the classifying routines 54 and 56 provide the desired comparison, then, the AND gate 58 is qualified, causing the firing circuit 44 to be qualified which, in turn, provides for the initiation of a detonation of the explosive charger 12. As previously discussed, elements 60, 62, 64 and 66 are utilized for the embodiment for multiple detonation of explosive charges which may be further described with reference to FIG. 4.

FIG. 4 illustrates an arrangement 95 comprised of one or more systems, e.g. 10(1), 10(2), . . . 10(n), each of which is remotely controlled for activating the firing device by providing output signal for detonating a respective explosive charge in a manner as previously described with reference to FIG. 1. For the arrangement 95 the first system, that is 10(1), serves as the initiation, controlling or master device for sympathetic detonating device of each of the remaining slave systems 10(2), . . . 10(n). All of the systems 10(1), 10(2), . . . 10(n) communicate with each other by means of the receiving signal 30 and the transmitting signal 32. The operation of the arrangement 95 may be described with simultaneous reference to FIGS. 2 and 4.

Figure 2:
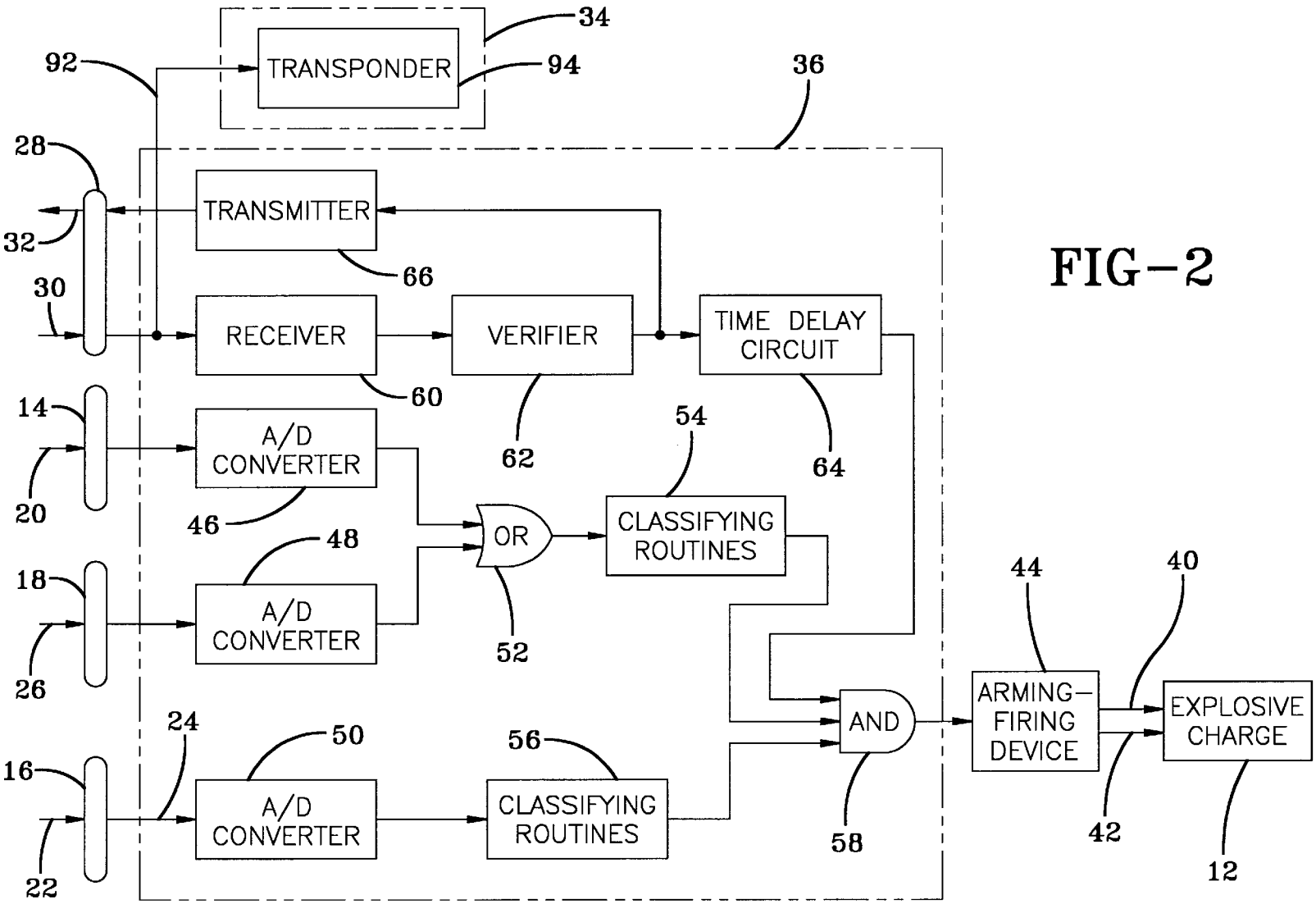
FIG. 2 is a block diagram of the electronics of the system of FIG. 1.

The master system 10(1) is activated by an external stimulus, by means of the received signal 30, which is routed to the receiver 60 shown in FIG. 2. The signal 30 applied to receiver 60 may also be routed, via signal path 92, to a transponder 94 within the battery compartment 34. The transponder 94 is preferably contained in each of the systems 10(1), 10(2) . . . 10(n). The transponder 94 may provide an output signal that is applied by activation means (known in the art) to activate the batteries within the battery compartment 34. In essence, the transponder 94 may be used to activate the batteries when the batteries full power needs to be used. Keeping the batteries in a low power mode reduces the overall power consumption of the electronics 36 and, thus, saves power.

The receiver 60 provides an output signal to the verifier 62 which examines the identification code carried by the signal 30 to determine if it correlates to the proper code which should cause activation of the firing device 44. If the verification is valid, verifier 62 transmits an output signal to the time delay circuit 64 and transmitter 66. The time delay 64 may be set from a period that may vary from a few seconds to several hours. Upon the expiration of the time delay of circuit 64, an output signal is applied to an AND circuit 58, which act as a coincidence circuit. If the second and third inputs of the AND circuit 58 are also qualified by the respective operation of the classifying routine 54 and 56, the AND circuit 58 provides an output signal to firing device 44 which, in turn, provides a signal on signal paths 40 and 42 to detonate the explosive charger 12.

The transmitter 66, which was in its so-called "sleep mode", in turn, sends a coded RF signal 32 containing its identification code serving as a "wake-up call" to the next system, which in FIG. 4 is system 10(2).

Figure 3:
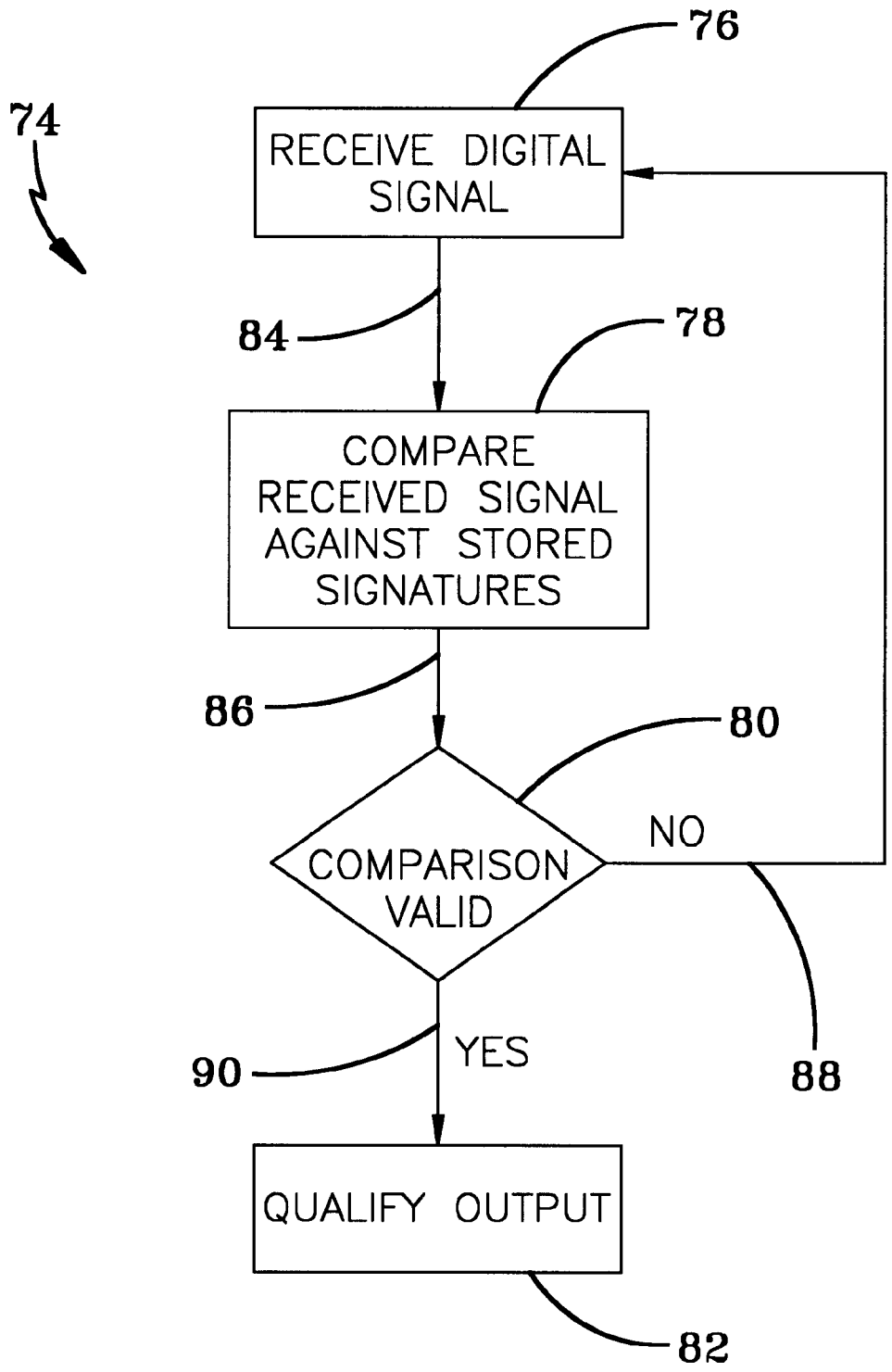
FIG. 3 is a flow chart of the classifying routines operating in the electronics of FIG. 2.

The system 10(2) upon verification of the identification code contained in the signal 32 by the operation of the verifier 62 of system 10(2) provides an output signal to the time delay circuit 64. The time delay circuit 64 of the system 10(2) provides an output signal to AND circuit 58 which, in turn, is qualified if the classifying routines 54 and 56 of FIG. 3 are satisfied. The AND circuit 58 of system 10(2) arms its firing device 44 which, in turn, provides activation of its explosive charge 12. The transmitter 66 of system 10(2) provides a wake-up call to the next system 10(3) which, in turn, operates in a manner as described for system 10(2) to provide a wake-up call and the activation of an associated explosive charge. This sequence continues until the final system 10(n) is activated and the final explosive charge is sympathetically activated.

It should now be appreciated that the practice of the present invention provides for a system for remotely controlling one or more firing devices which, in turn, provide an output signal for detonating a respective explosive charge.

It should be further appreciated that the present invention also provide a wake-up signal by way transponder 94 to wake-up or activate the batteries so as to reduce the power consumption of the system 10.

It should be still further appreciated that the system for the present invention by employing three separate sensors each having an independent signature makes the overall system almost impervious to any false alarms as well as any counter intelligence directed to the system of the present invention.

Although the invention has been described relative to a specific embodiment thereof, there are numerous variations and modifications that will be readily apparent to those skilled in the art in light of the above teaching. It is, therefore, understood that within the scope of the independent claims, the invention may be practiced other than as specifically described.

What we claim is:

1. A system for remotely controlling one or more arming-firing devices each providing an output signal for detonating a respective explosive charge, each arming device having:

one or more sensors selected from the group consisting of an acoustic sensor, a seismic sensor and a hydrophone sensor, each sensor providing an analog output signal;

an analog to digital (A/D) converter for each of the one or more selected sensor and each A/D converter receiving a respective analog signal and providing a corresponding output digital signal;

a classifier for each of the one or more A/D converters and each classifier receiving the respective digital signal and comparing the received digital signal against one or more predetermined quantities and providing an output signal if a match exists therebetween;

an antenna for picking up a received signal carrying an identification code and for radiating a transmitted signal carrying an identification code;

a receiver for receiving the signal picked up by said antenna and providing a corresponding output thereof;

a verifier for accepting the output of said receiver and determining if said accepted output has a first predetermined identification code and, if so, providing an output verifier signal;

a circuit having a first variable time delay receiving said output of said verifier and providing an output signal upon the expiration of said first variable time delay;

a coincidence circuit receiving the output signals of each classifier and of said first variable time delay circuit and generating an output signal when said output signals of said classifiers and of said first variable time delay circuit are in coincidence, said output signal of said coincidence circuit being applied to said arming-firing device which, in turn, generates an output signal in response thereto;

a transmitter receiving said output verifier signal and generating a signal carrying a second predetermined identification code which is applied to said antenna.

2. The system according to claim 1, further comprising a transponder responsive to the signal received by said receiver and which provides an output signal used to activate batteries for powering said system.

* * * * *